US008714378B2

(12) United States Patent
Maxeiner et al.

(10) Patent No.: US 8,714,378 B2
(45) Date of Patent: May 6, 2014

(54) COUPLER KNUCKLE SYSTEM AND METHOD

(75) Inventors: Michael D. Maxeiner, Coraopolis, PA (US); Anthony J. Sicilia, McKees Rocks, PA (US)

(73) Assignee: McConway & Torley LLC, Dallas, TX (US)

( * ) Notice: Subject to any disclaimer, the term of this patent is extended or adjusted under 35 U.S.C. 154(b) by 221 days.

(21) Appl. No.: 13/063,417

(22) PCT Filed: Sep. 17, 2009

(86) PCT No.: PCT/US2009/057305

§ 371 (c)(1),
(2), (4) Date: Mar. 10, 2011

(87) PCT Pub. No.: WO2010/033694

PCT Pub. Date: Mar. 25, 2010

(65) Prior Publication Data

US 2011/0266242 A1 Nov. 3, 2011

Related U.S. Application Data

(60) Provisional application No. 61/192,659, filed on Sep. 18, 2008.

(51) Int. Cl.
*B61G 3/04* (2006.01)

(52) U.S. Cl.
USPC ..... 213/155; 213/151

(58) Field of Classification Search
USPC ..... 213/151, 152, 155, 118; 164/137
See application file for complete search history.

(56) References Cited

U.S. PATENT DOCUMENTS

| | | | | |
|---|---|---|---|---|
| 2,688,412 | A * | 9/1954 | Kulieke | 213/155 |
| 4,206,849 | A | 6/1980 | Kaim | 213/151 |
| 5,582,307 | A | 12/1996 | Hawthorne et al. | 213/109 |
| 7,337,826 | B2 | 3/2008 | Mautino et al. | 164/137 |
| 2006/0113267 | A1 * | 6/2006 | Mautino et al. | 213/118 |
| 2007/0125510 | A1 | 6/2007 | Mautino et al. | 164/137 |

FOREIGN PATENT DOCUMENTS

| | | | |
|---|---|---|---|
| CN | 101010231 | 8/2007 | B22C 9/10 |
| CN | 101074737 | 11/2007 | B29C 39/00 |
| GB | 546906 A | 8/1942 | |

OTHER PUBLICATIONS

Notification concerning International Preliminary Report on Patentability and Written Opinion regarding PCT/US2009/057305; The International Bureau of WIPO; Switzerland; pp. 7, Mar. 31, 2011.
International Search Report & Written Opinion, Application No. PCT/US2009/057305, 9 pages, Nov. 6, 2009.

(Continued)

*Primary Examiner* — Zachary Kuhfuss
(74) *Attorney, Agent, or Firm* — Baker Botts L.L.P.

(57) ABSTRACT

A method for manufacturing a railcar coupler knuckle includes providing a first mold section having internal walls defining at least in part perimeter boundaries of a first coupler knuckle mold cavity. The method includes providing a second mold section having internal walls defining at least in part perimeter boundaries of a second coupler knuckle mold cavity. The second coupler mold cavity of the second mold section is offset from the first coupler mold cavity of the first mold section. The method includes closing the first and second mold sections and at least partially filling the first and second coupler knuckle mold cavities with a molten alloy, the molten alloy solidifying after filling to form the coupler knuckle.

15 Claims, 6 Drawing Sheets

(56) References Cited

OTHER PUBLICATIONS

The First Office Action of the State Intellectual Property Office of the People's Republic of China, w/English translation; Application No. 200980136905.9; pp. 18, Oct. 31, 2012.

The Second Office Action of the State Intellectual Property Office of the People's Republic of China; Application No. 200980136905.9; p. 7, Aug. 14, 2013.

Office Action of the Mexican Patent Office; Application NoMX/a/2011/003004; pp. 6, Aug. 15, 2013.

* cited by examiner

COUPLER KNUCKLE SYSTEM AND METHOD

CROSS REFERENCE TO RELATED APPLICATIONS

This application is a U.S. National Stage Application of International Application No. PCT/US2009/057305 filed Sep. 17, 2009, which designates the United States and claims priority to U.S. Patent Application Ser. No. 61/192,659, entitled "COUPLER KNUCKLE SYSTEM AND METHOD," which was filed on Sep. 18, 2008, which are hereby incorporated by reference in their entirety.

TECHNICAL FIELD

This invention relates in general to railcars and, more particularly, to a coupler knuckle system and method.

BACKGROUND

Railcar couplers are disposed at each end of a railway car to enable joining one end of such railway car to an adjacently disposed end of another railway car. The engageable portions of each of these couplers is known in the railway art as a knuckle. For example, railway freight car coupler knuckles are taught in U.S. Pat. Nos. 4,024,958; 4,206,849; 4,605,133; and 5,582,307.

Knuckle failure accounts for about 100,000 train separations a year, or about 275 separations per day. Most of these separations occur when the train is out of a maintenance area. In such cases, a replacement knuckle, which can weigh about 80 pounds, must be carried from the locomotive at least some of the length of the train, which may be up to 25, 50 or even 100 railroad cars in length. The repair of a failed coupler knuckle can be labor intensive, can sometimes take place in very inclement weather and can cause train delays.

Over the years it has been discovered, in the railroad industry, that relatively small point to point contact surfaces of the engaged portions of these knuckles can cause premature failure due to stress points being established within the knuckle. These coupler knuckles are generally manufactured from a cast steel and during the casting process itself the interrelationship of the mold and cores disposed within the mold are critical to producing a satisfactory railway freight car coupler knuckle. For example, if, during such casting process, the mold should happen to slip or shift along the parting line for any reason then a detrimental point to point surface contact can be established in the finished knuckle.

It has generally been difficult to manufacture coupler knuckle castings lacking the geometry that results in the point to point contact surface engagement with other knuckles. One reason for this is the draft angles which are generally required in order to produce a satisfactory casting. Typically, a mold cavity is made using a pattern. The pattern has slight draft angles, often between about 2° and about 3°, in order to allow the pattern to be withdrawn from the mold cavity. Without the draft angles, the withdrawal of the pattern from the mold cavity can result in the sidewalls defining a perimeter boundary of the mold cavity partially collapsing or otherwise deforming.

One solution used in an attempt to provide a satisfactory surface involves either grinding or machining the contact or bearing surfaces of the knuckle. However, grinding and/or machining of such surface can add substantially to the cost of producing a satisfactory coupler. Moreover, grinding the bearing surfaces can also establish point to point contact in a number of other places, and, as discussed above, this can add stress to the coupler knuckle and result in premature and unpredictable knuckle failure.

SUMMARY

Particular embodiments provide a coupler knuckle method and system that substantially eliminates or reduces at least some of the disadvantages and problems associated with previous methods and systems.

In accordance with a particular embodiment, a method for manufacturing a railcar coupler knuckle includes providing a first mold section having internal walls defining at least in part perimeter boundaries of a first coupler knuckle mold cavity. The method includes providing a second mold section having internal walls defining at least in part perimeter boundaries of a second coupler knuckle mold cavity. The second coupler mold cavity of the second mold section is offset from the first coupler mold cavity of the first mold section. The method includes closing the first and second mold sections and at least partially filling the first and second coupler knuckle mold cavities with a molten alloy, the molten alloy solidifying after filling to form the coupler knuckle In accordance with another embodiment, a railcar coupler knuckle comprising a tail section and a hub section. The hub section has a pivot pinhole formed therein. The knuckle also includes a front face section connected to the hub section. The front face section includes a nose section and a pulling face portion formed inwardly from the nose section. At least a portion of the pulling face portion includes a parting line offset from a center line of the pulling face portion.

Technical advantages of particular embodiments include a coupler knuckle system and method that eliminates a parting line in a load path or bearing surface of the coupler knuckle. Other technical advantages of particular embodiments include the use of cope and drag mold portions offset at a pulling face portion of the knuckle to increase the strength of the knuckle at this portion and its ability to withstand high impact operational forces thereby increasing knuckle lifespan. The pulling face portion may include a substantially flat bearing surface area to distribute the contact load between two adjoining knuckles more evenly. Particular embodiments with an offset parting line add material in the transition areas above and below the pulling face. Particular embodiments also have a clear and even transition from the pulling face to the rest of the knuckle.

Other technical advantages will be readily apparent to one skilled in the art from the following figures, descriptions and claims. Moreover, while specific advantages have been enumerated above, various embodiments may include all, some or none of the enumerated advantages.

BRIEF DESCRIPTION OF THE DRAWINGS

For a more complete understanding of the present invention and its advantages, reference is now made to the following description, taken in conjunction with the accompanying drawings, in which.

DETAILED DESCRIPTION

Figure 1:
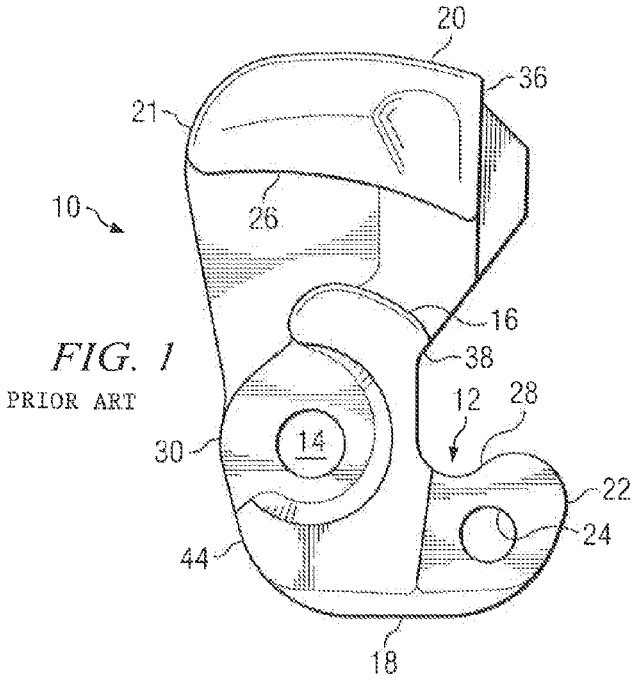
FIG. 1 PRIOR ART
FIG. 1 illustrates a top view of a coupler knuckle.

FIG. 1 is a top view of an example coupler knuckle 10. Coupler knuckle 10 includes a tail section 20, a hub section 30, and a front face section 18. Hub section 30 includes a pivot pin hole 14 formed therein for receiving a pivot pin to pivotally couple the knuckle 10 to a coupler for coupling to a railcar. Pivot pin hole 14 may have generally cylindrical sidewalls and may have a middle region lacking sidewalls. Coupler knuckle 10 also includes a buffing shoulder 16, a tail stop 21, a pulling lug 26, a lock wall 36, a throat 38, and a heel 44.

Front face section 18 includes a nose section 22, which includes a generally cylindrical flag opening 24 formed in an end region of the nose section 22. A pulling face portion 28 is disposed inwardly from nose section 22. At least a portion of the pulling face portion 28 includes a bearing surface area 12 which bears against a similar surface of a coupler knuckle of an adjacent railcar to couple the railcars together.

Figure 2:
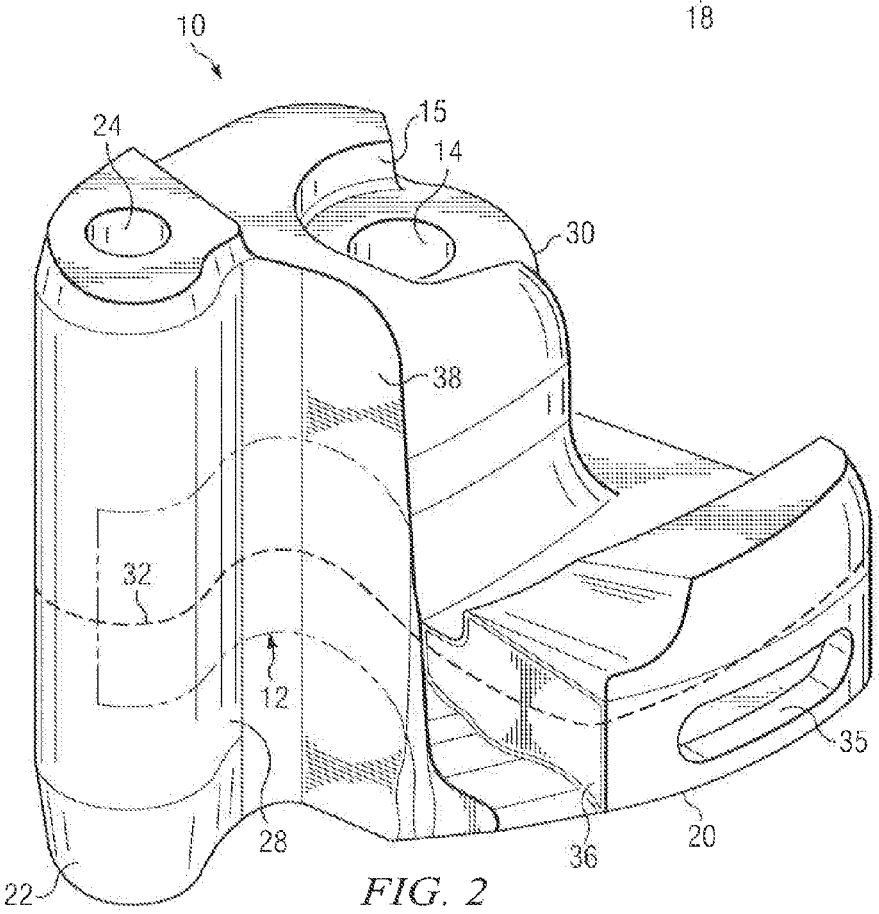
FIG. 2 PRIOR ART
FIG. 2 is an isometric view of the coupler knuckle of FIG. 1.
Figure 3:
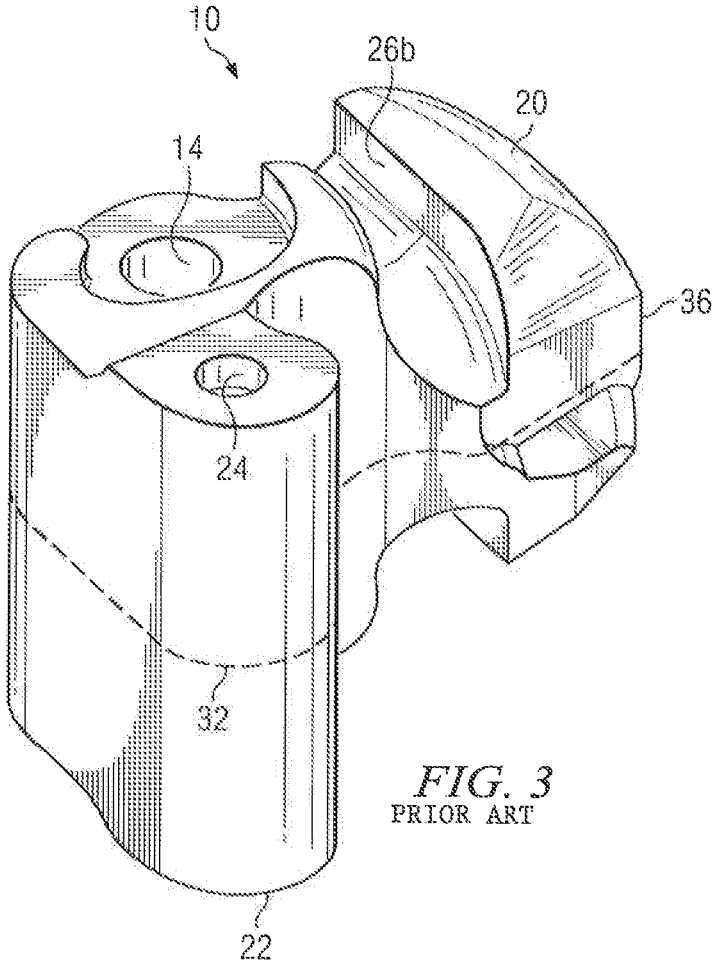
FIG. 3 PRIOR ART
FIG. 3 is another isometric view of the coupler knuckle of FIG. 1.

FIGS. 2 and 3 are isometric views of the example coupler knuckle 10 of FIG. 1. Evident in FIGS. 2 and/or 3 are tail section 20, nose section 22, pulling lug 26, hub section 30, bearing surface area 12, pivot pin hole 14, flag opening 24, pulling face portion 28, lock wall 36, throat 38, and parting line 32. Tail section 20 includes an opening 35. The illustrated embodiment also includes a pin protection portion 15 to provide protection for the pivot pin during use of the knuckle.

Coupler knuckles include various surfaces and cavities that conform to standard specifications as set forth by the Standard Coupler Manufacturers Committee. Casting gages are designed to be applied to the coupler knuckle in a prescribed manner to verify that certain dimensions of the knuckle fall within an allowable variation or tolerance range. Gages have a primary role in guaranteeing the uniformity of all manufacturers' knuckles. Railroad cars that operate in interchange traffic, switching from one train to another, are required to be equipped with couplers and other draft system components which will reliably mate with other assembly components.

One manner in which a coupler knuckle may be manufactured to conform to standard specifications is through a casting process with steel or other alloy. The casting process typically includes the use of cope and drag mold sections and one or more cores that aid in forming appropriate cavities within the coupler and external surfaces of the coupler. The cores are typically made of resin or otherwise hardened sand.

The cope and drag mold sections each include internal walls, formed of sand using a pattern or otherwise, that define at least in part perimeter boundaries coupler knuckle mold cavities. Sand, such as green sand, may be used to define the interior boundary walls of the mold cavities. The mold cavities correspond to the desired shape and configuration of a coupler knuckle to be cast using the cope and drag mold sections. The cope and drag mold sections are placed together such that their respective mold cavities form one large cavity that is filled with steel or other alloy that solidifies to form the coupler knuckle. The mold cavities may include a gating system for allowing molten alloy to enter the mold cavity. As discussed above, one or more cores may be positioned within the mold cavity to form internal cavities or other surfaces of the coupler knuckle.

This conventional manufacturing process creates parting line 32 on the knuckle where the mold cavities of the cope and drag sections meet. This parting line runs approximately midway between top and bottom portions of the knuckle since a depth of the mold cavity in the cope section may be approximately equal to a depth of the mold cavity in the drag section. Thus, parting line 32 may run generally along a center line of the knuckle at the pulling face portion of the knuckle. The parting line may be further accentuated by the pattern draft angles, often between about 2° and about 3°, generally required in order to allow the pattern to be withdrawn from the mold cavity. This increases the chance of forming a bearing surface area with a raised point running through the bearing surface area at the parting line. Parting line 32 extends within bearing surface area 12 that bears the most force from a knuckle coupled to an adjacent railcar. The parting line many times results in a raised surface that increases the chance of detrimental point to point contact surfaces of the engaged portions of these knuckles which can cause premature failure due to stress points being established within the knuckle point. In some cases, bearing surface area 12 may have a height of approximately four inches and be generally centered between the illustrated top and bottom portions of the coupler knuckle. In some cases, the coupler knuckle may have a total height at the bearing surface area of approximately 11 inches.

Figure 4:
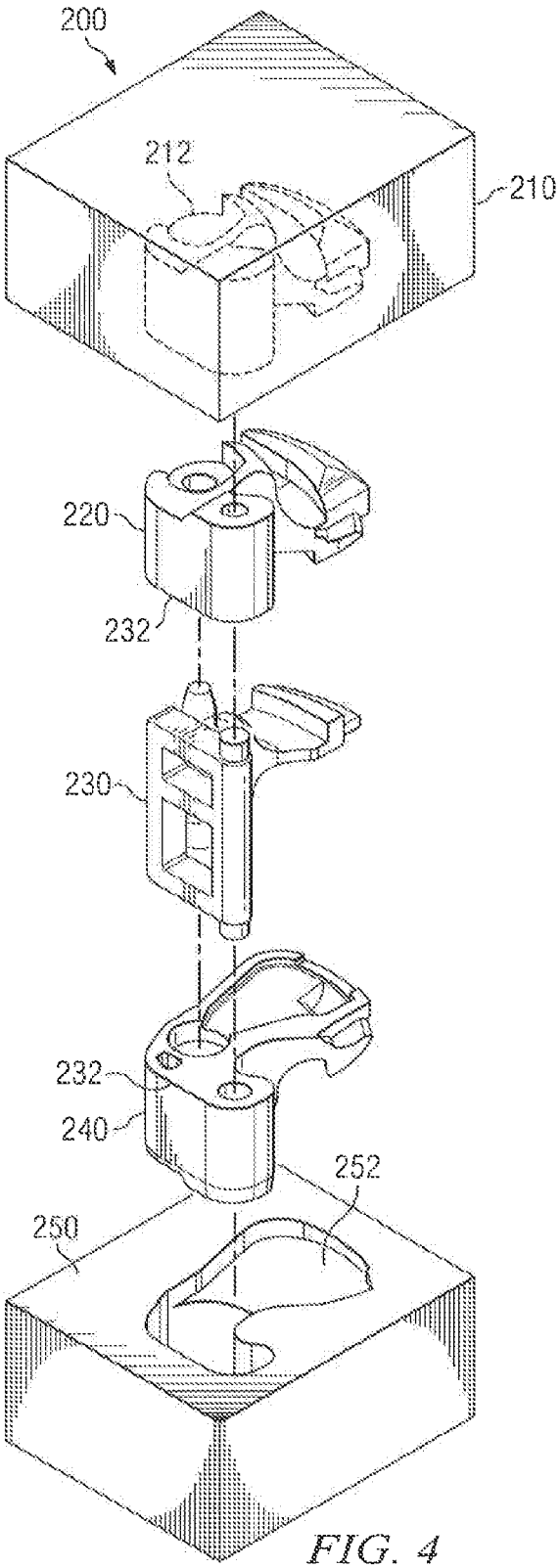
FIG. 4 PRIOR ART
FIG. 4 is a schematic illustration of a coupler knuckle manufacturing assembly.

FIG. 4 is a schematic illustration of a conventional coupler knuckle manufacturing assembly. Knuckle manufacturing assembly 200 includes a cope mold section 210, an upper section 220 of a coupler knuckle, a core 230 used in the manufacturing process to create internal knuckle cavities, a lower section 240 of the coupler knuckle and a drag mold section 250.

Cope mold section 210 and drag mold section 250 include mold cavities 212 and 252, respectively. Mold cavities 212 and 252 are configured to correspond to the desired external surfaces of the coupler knuckle to be manufactured using cope and drag mold sections 210 and 250. Core 130 includes finger, pivot pin and kidney portions to form corresponding cavities within the coupler knuckle. Once the cores are in place, the cope and drag mold portions may be brought together and closed. The cavity may be filled with molten alloy, which takes up all the space open between the cope and drag portions and the cores. After solidifying, the cope and drag mold portions are separated, and the casting is shaken out resulting in the breaking up of the cores and their exit from designed openings in the casting. As discussed above, this conventional manufacturing process creates a parting line 232 on the knuckle where the mold cavities of the cope and drag sections meet.

Figure 5:
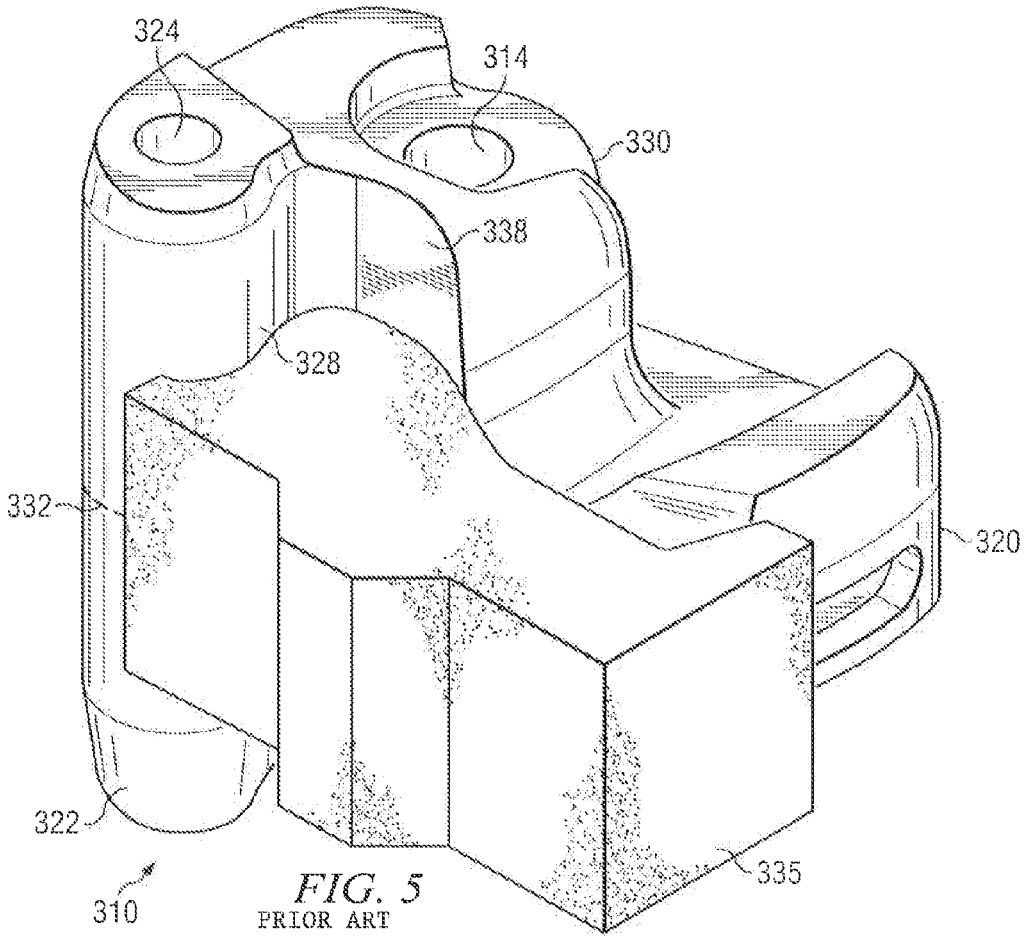
FIG. 5 PRIOR ART
FIG. 5 illustrates a coupler knuckle adjacent an external manufacturing core.

In the manufacturing of some coupler knuckles, an additional core may be used to define a bearing surface area that will bear the impact and forces of an adjacent knuckle when two railcars are coupled together, as described in U.S. Pat. No. 7,337,826 which is hereby incorporated by reference herein in its entirety. FIGURE illustrates a coupler knuckle 310 adjacent such an additional core 335 used to form the bearing surface during casting. This core may be positioned in the mold cavity of either the cope or drag sections for forming the bearing surface area. As evident, the use of core 335 may eliminate parting line 332 from extending to a bearing surface area of the coupler knuckle. However, the use of cores such as this external core in the manufacturing process presents variability issues as a result of potential movement of the core during casting. In addition, the use of such a core adds time and expense to the manufacturing process for the formation of the core and for its placement into the mold. Also evident in FIG. 5 are tail section 320, nose section 322, hub section 330, pivot pin hole 314, flag opening 324, and throat 338.

Figure 6:
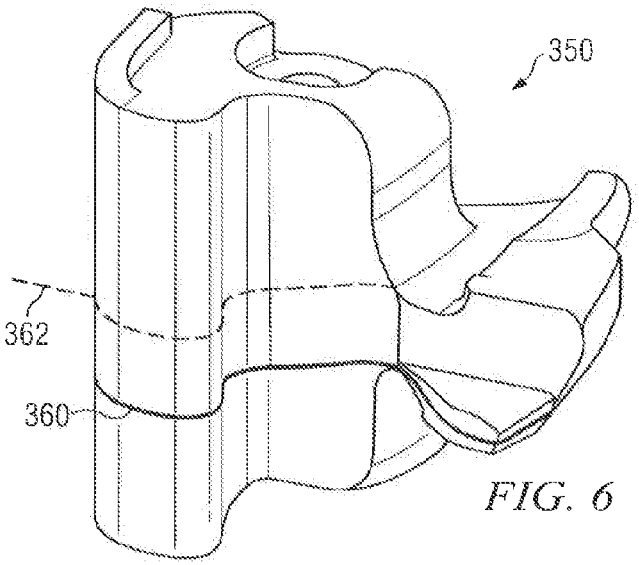
FIG. 6 illustrates a coupler knuckle, in accordance with a particular embodiment.

FIG. 6 illustrates a coupler knuckle 350, in accordance with a particular embodiment. Knuckle 350 includes a parting line 360 that is offset from the generally centered nature of parting lines in conventional knuckles. For example, parting line 360 is offset from a center line 362 at the pulling face portion of knuckle 350. As a result, parting line 360 does not run through a bearing surface of the knuckle. This increases the knuckle load-bearing consistency and leads to a longer knuckle life. In some embodiments, parting line 360 may be two inches or more away from a center line between the top and bottom portions of the knuckle at the pulling face portion.

Figure 7:
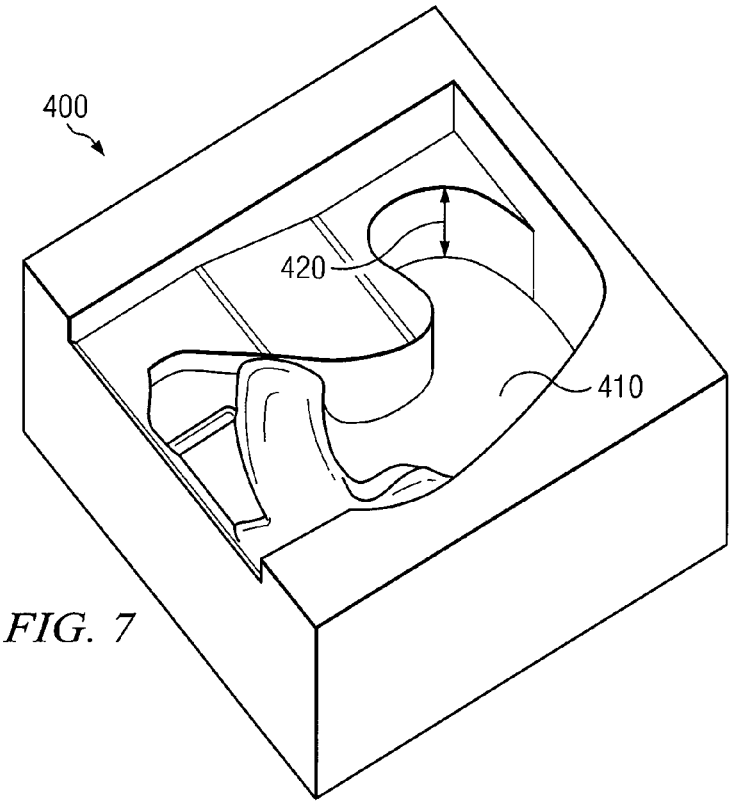
FIG. 7 illustrates a cope mold portion used to form a coupler knuckle, in accordance with a particular embodiment.

FIG. 7 illustrates a cope mold portion 400 used to form a coupler knuckle, in accordance with a particular embodiment. Cope mold portion 400 includes a cope mold cavity 410. While the face of the specific mold cavity surface that forms the pulling face portion with the bearing surface area is at least partially hidden as a result of the angle of the figure, referenced height 420 of the cavity generally corresponds to a height of the cavity at the pulling face portion. In some embodiments, referenced height 420 may be approximately 3.1875 inches or approximately 3.5 inches. In some embodiments, this height may be in the range of approximately 3 to 4 inches or approximately 2.5 to 5 inches.

Figure 8:
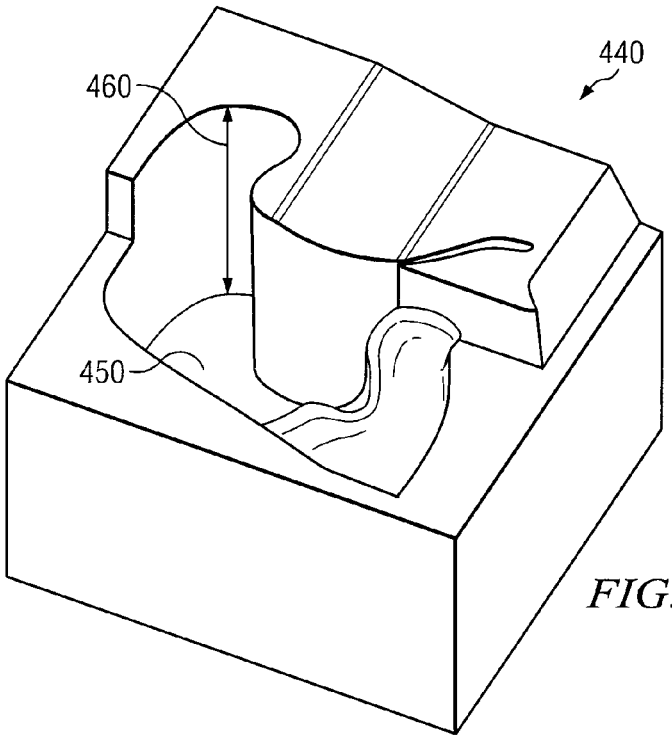
FIG. 8 illustrates a drag mold portion used to form a coupler knuckle, in accordance with a particular embodiment.

FIG. 8 illustrates a drag mold portion 440 used to form a coupler knuckle, in accordance with a particular embodiment. Drag mold portion 440 includes a drag mold cavity 450. While the face of the specific mold cavity surface that forms the pulling face portion with the bearing surface area is at least partially hidden as a result of the angle of the figure, referenced height 460 of the cavity generally corresponds to a height of the cavity at the pulling face portion. In some embodiments, referenced height 460 may be approximately 7.8125 inches or approximately 7.5 inches. In some embodiments, this height may be in the range of approximately 7 to 8 inches or approximately 6 to 8.5 inches.

Since referenced heights 420 and 460 of cope and drag mold cavities 410 and 450, respectively, generally correspond to the heights of their respective mold cavities at the knuckle pulling face portion, the combination of their heights generally corresponds to the height of the knuckle at the pulling face portion. As evident, these heights are not equal (height 460 is greater than height 420)—this creates an offset in the cope and drag mold cavities at the pulling face portion of the knuckle. Since it is where these mold cavities meet that forms the parting line in the knuckle, the parting line in a knuckle formed by using cope mold portion 400 and drag mold portion 440 will be offset from a general center line of the knuckle at the pulling face portion. In some embodiments, this parting line may be approximately 2 inches or more from a general center line of the knuckle at the pulling face portion. This may ensure that the parting line does not extend through a bearing surface area of the pulling face portion such as bearing surface area 12 of knuckle 10 of FIGS. 1-3.

In some embodiments, the offsets illustrated in the cope and drag mold portions 400 and 440 may be reversed such that the offset in 400 may occur in the drag portion and vice versa.

Figure 9:
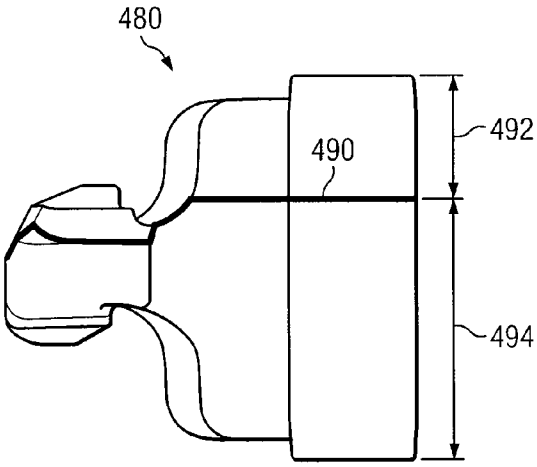
FIG. 9 illustrates a coupler knuckle, in accordance with a particular embodiment.

FIG. 9 illustrates a coupler knuckle 480, in accordance with a particular embodiment. Knuckle 480 is formed with cope and drag mold sections with offset mold cavities such that parting line 490 is offset from a general center line of the knuckle at particular locations on the knuckle. For example, while the specific pulling face portion of the knuckle is at least partially hidden in this figure, it is evident that the parting line runs below a center line of the knuckle at the pulling face portion. Referenced distance 494 may correspond to a height of a cope mold cavity at that location on the knuckle, and referenced distance 492 may correspond to a height of a drag mold cavity at that location, or vice versa.

In some embodiments, the total vertical distance of the coupler at the bearing surface area is approximately 11 inches. In some embodiments, referenced distance 494 at the bearing surface area may be approximately 7.5 inches or, in some cases, approximately 7 13/16 inches; and distance 492 at the bearing surface area may be approximately 3.5 inches or, in some cases, approximately 3 3/16 inches. In some embodiments, referenced distance 492 at the bearing surface area may be in the range of approximately 3 to 4 inches or in the range of approximately 2.5 to 5 inches. In some embodiments, referenced distance 494 at the bearing surface area may be in the range of approximately 7 to 8 inches or in the range of approximately 6 to 8.5 inches.

As discussed elsewhere, in some embodiments the location of the parting line may be reversed such that referenced distance 492 at the bearing surface area may be greater than referenced distance 494 at the bearing surface area.

Figure 10:
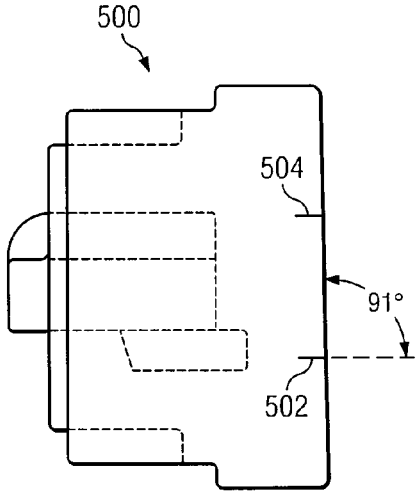
FIG. 10 illustrates a pattern used for forming the mold cavities for forming a knuckle having the described offset, in accordance with a particular embodiment.

FIG. 10 illustrates a pattern 500 used for forming the mold cavities for forming a knuckle having the described offset, in accordance with a particular embodiment. When forming the mold cavities, the pattern itself may be tilted on the pattern plate. To avoid a point caused by a draft from the offset parting line on an offset pattern as described and illustrated, the pattern may be tilted at 1° relative to the offset parting line so the "flat" portion of the knuckle pattern, between references 502 and 504, can be pulled from the mold without drafting it. This increases the likelihood of achieving a flatter bearing surface area with an offset parting line. Thus, in some cases the pattern and/or mold cavities may be tilted (e.g., at approximately 1 degree) about the parting line to ensure a flatter surface at the bearing surface area of the knuckle.

Figure 11:
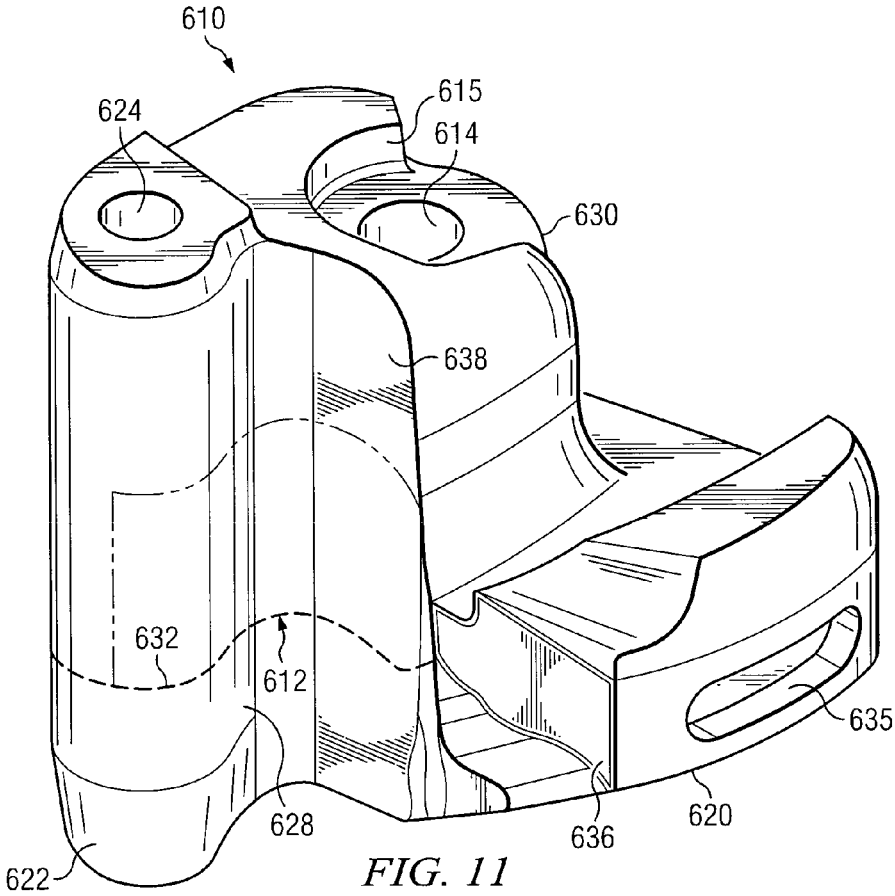
FIG. 11 illustrates a coupler knuckle, in accordance with a particular embodiment.

FIG. 11 illustrates a coupler knuckle 610, in accordance with a particular embodiment. Coupler knuckle 610 includes tail section 620, nose section 622, hub section 630, bearing surface area 612, pivot pin hole 614, flag opening 624, pulling face portion 628, lock wall 636, throat 638, pin protection portion 15, and parting line 632. Tail section 620 includes an opening 635.

As evident, parting line 632 (which is illustrated through only the nose and pulling face portions and is thus only partially illustrated) does not run through a center line of the knuckle at the pulling face portion. In some embodiments, parting line 632 may be approximately two inches or more from a center line of the knuckle at the pulling face portion. In this embodiment, parting line 632 does not run through bearing surface area 612 which leads to a flatter bearing surface area than a conventional knuckle having a bearing surface with a parting line through it. This leads to a reduced risk of point to point contact in the bearing surface, reduced chance of knuckle failure during operation, and longer life. Mold cavities of cope and drag portions used to form knuckle 610 may be offset to form a parting line away from a center line of the knuckle at the pulling face portion as described above. In various embodiments, offset parting line 632 may continue around the knuckle and return at any suitable location and still provide the benefits discussed herein. Specifically, in some embodiments, an offset parting line may extend into a nose section and further around a front face section of a coupler knuckle and return to a center line position elsewhere on the knuckle.

While particular knuckles are discussed herein with parting lines at various locations, it should be understood that coupler knuckles can be formed with parting lines at any suitable offset location at the pulling face portion in accordance with various embodiments. Cope and drag mold cavities may have any suitable configuration to form such offset parting line. In some cases, other manufacturing processes may be used without cope and drag mold portions to create a knuckle that does not include a parting line through its bearing surface area.

Coupler knuckles manufactured in accordance with particular embodiments may be provided in the combination of a railway freight car coupler (not shown) having incorporated therein the coupler knuckle casting as described. The knuckles may also be configured to be suitable for retrofitting an existing railway freight car couplers (not shown).

Although the present invention has been described in detail with reference to particular embodiments, it should be understood that various other changes, substitutions, and alterations may be made hereto without departing from the spirit and scope of the present invention. The present invention contemplates great flexibility in the manufacturing process of coupler knuckles and the shape, configuration and arrangement of one or more internal cores used in the manufacturing process.

Numerous other changes, substitutions, variations, alterations and modifications may be ascertained by those skilled in the art and it is intended that the present invention encompass all such changes, substitutions, variations, alterations and modifications as falling within the spirit and scope of the appended claims.

What is claimed is:

1. A railcar coupler knuckle, comprising:

a tail section;

a hub section, said hub section having a pivot pinhole formed therein, the pivot pinhole comprising a substantially vertical longitudinal axis;

a front face section connected to said hub section, said front face section including a nose section and a pulling face portion formed inwardly from said nose section; and the knuckle including a parting line traversing around at least a portion of the knuckle, the parting line comprising a portion that is non-horizontal, wherein at at least a portion of said pulling face portion the parting line is offset from a center line of the pulling face portion.

2. The railcar coupler knuckle of claim 1, wherein the parting line is approximately two inches from the center line of the knuckle at the pulling face portion.

3. The railcar coupler knuckle of claim 1, wherein the parting line is greater than two inches from the center line of the knuckle at the pulling face portion.

4. The railcar coupler knuckle of claim 1, wherein the parting line is approximately 3.1875 inches from a top of the knuckle at the pulling face portion and approximately 7.8125 inches from a bottom of the knuckle at the pulling face portion.

5. The railcar coupler knuckle of claim 1, wherein the parting line is approximately 7.8125 inches from a top of the knuckle at the pulling face portion and approximately 3.1875 inches from a bottom of the knuckle at the pulling face portion.

6. The railcar coupler knuckle of claim 1, wherein a ratio between a first distance of the parting line from a top of the knuckle at the pulling face portion and a second distance of the parting line from the bottom of the knuckle at the pulling face portion is approximately 2.14 to 1.

7. A railcar coupler knuckle, comprising:

a tail section;

a hub section, said hub section having a pivot pinhole formed therein, the pivot pinhole comprising a substantially vertical longitudinal axis;

a front face section connected to said hub section, said front face section including a nose section and a pulling face portion formed inwardly from said nose section, at least a portion of said pulling face portion including a bearing surface area;

wherein the knuckle includes a parting line traversing around at least a portion of the knuckle, the parting line comprising a portion that is non-horizontal, wherein the parting line does not run in the bearing surface area of the pulling face portion; and wherein the parting line extends around a portion of the nose section and is offset from a center line of the portion of the nose section.

8. A method for manufacturing a railcar coupler knuckle, comprising:

providing a first mold section having internal vertical walls defining at least in part perimeter boundaries of a first coupler knuckle mold cavity;

providing a second mold section having internal vertical walls defining at least in part perimeter boundaries of a second coupler knuckle mold cavity, wherein the second coupler mold cavity of the second mold section is offset from the first coupler mold cavity of the first mold section;

closing the first and second mold sections;

at least partially filling the first and second coupler knuckle mold cavities with a molten alloy, the molten alloy solidifying after filling to form the coupler knuckle; and wherein the formed coupler knuckle includes a parting line traversing around at least a portion of the knuckle, the parting line comprising a portion that is non-horizontal, wherein at at least a portion of the pulling face portion the parting line is offset from a center line of the pulling face portion as a result of the offset of the second mold section of the second coupler mold cavity from the first mold section of the first coupler mold cavity.

9. The method of claim 8, wherein the parting line is approximately two inches from the center line of the knuckle at the pulling face portion.

10. The method of claim 8, wherein the parting line is greater than two inches from the center line of the knuckle at the pulling face portion.

11. The method of claim 8, wherein the first mold section comprises a cope mold section and the second mold section comprises a drag mold section.

12. The method of claim 8, wherein the first mold section comprises a drag mold section and the second mold section comprises a cope mold section.

13. The method of claim 8, further comprising positioning one or more internal cores within either the first mold section or the second mold section such that one or more internal cavities are formed in the coupler knuckle from time solidifying of the molten alloy around the one or more internal cores.

14. The method of claim 8, wherein:

a first depth of the first mold cavity of the first mold section at a portion of the mold cavity forming the exterior surface of a pulling face portion of the knuckle is approximately 3.1875 inches; and a second depth of the second mold cavity of the second mold section at a portion of the mold cavity forming the exterior surface of a pulling face portion of the knuckle is approximately 7.8125 inches.

15. The method of claim 8, wherein a ratio between a first depth of the first mold cavity of the first mold section at a portion of the mold cavity forming the exterior surface of a pulling face portion of the knuckle to a second depth of the second mold cavity of the second mold section at a portion of the mold cavity forming the exterior surface of a pulling face portion of the knuckle is approximately 2.14 to 1.

* * * * *